US006315491B1

(12) United States Patent
Scribner et al.

(10) Patent No.: US 6,315,491 B1
(45) Date of Patent: Nov. 13, 2001

(54) ROADWAY MARKER DEVICE

(76) Inventors: William C. Scribner; Valerie Scribner, both of 1505 Avenue K, Sterling, IL (US) 61081

( * ) Notice: Subject to any disclaimer, the term of this patent is extended or adjusted under 35 U.S.C. 154(b) by 0 days.

(21) Appl. No.: 09/453,629

(22) Filed: Dec. 3, 1999

(51) Int. Cl.[7] ..... E01F 9/06; E01F 9/08

(52) U.S. Cl. ..... 404/13; 404/9; 404/12; 404/14

(58) Field of Search ..... 404/9, 12, 13, 404/14, 15, 16

(56) References Cited

U.S. PATENT DOCUMENTS

| | | | | |
|---|---|---|---|---|
| D. 172,324 | * | 5/1954 | Wiswell | D10/109 |
| D. 397,555 | | 9/1998 | Nestegard et al. . | |
| 2,174,637 | * | 10/1939 | Osbrink | 404/9 |
| 2,184,492 | * | 12/1939 | French | 404/9 |
| 2,430,534 | | 11/1947 | Rodli . | |
| 2,603,909 | * | 7/1952 | Pettibone | 404/9 |
| 4,818,138 | * | 4/1989 | Brown | 404/14 |
| 4,875,799 | * | 10/1989 | Harrison | 404/12 |
| 5,006,010 | * | 4/1991 | Duckett | 404/12 |
| 5,013,181 | * | 5/1991 | Harrison | 404/12 |
| 5,097,358 | | 3/1992 | Ito et al. . | |
| 5,108,218 | | 4/1992 | Wyckoff . | |
| 5,242,242 | * | 9/1993 | Young | 404/12 |
| 5,327,850 | | 7/1994 | Sly et al. . | |
| 5,437,907 | * | 8/1995 | Peil et al. | 428/143 |
| 5,679,437 | | 10/1997 | Hackworth et al. . | |

* cited by examiner

*Primary Examiner*—H. Shackelford
*Assistant Examiner*—Gary S. Hartmann

(57) ABSTRACT

A roadway marker device for marking a roadway with marker embedded in the roadway. The roadway marker device includes an elongate member having a first end and a second end. The elongate member has a top wall and a bottom wall. A reflective strip enhances night time visibility of the elongate member. The reflective strip has a first side and a second side. The first side of the strip is adapted to reflect light. The second side of the strip has adhesive thereon. The second side of the strip is adhesively coupled to a surface of the top wall of the elongate member. The elongate members are placed in the roadway such that the top wall of the elongate member is generally flush with the roadway.

9 Claims, 2 Drawing Sheets

FIG 1
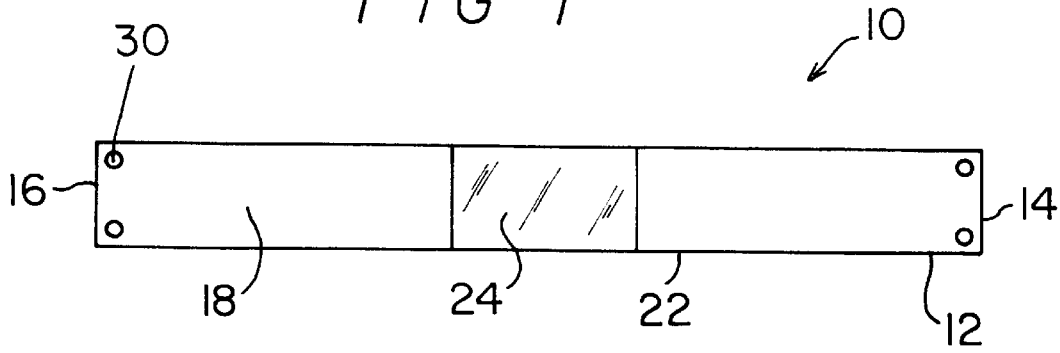
FIG 2
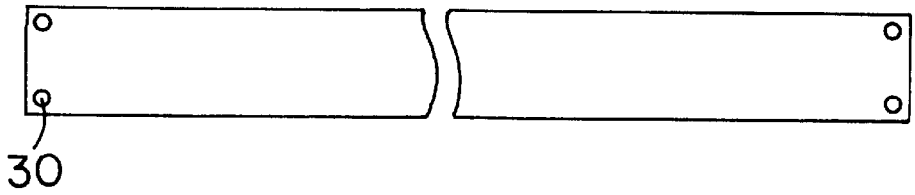
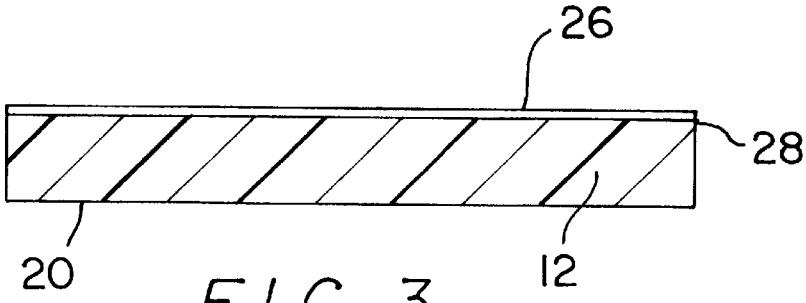
FIG 3

ROADWAY MARKER DEVICE

BACKGROUND OF THE INVENTION

1. Field of the Invention

The present invention relates to roadway marker devices and more particularly pertains to a new roadway marker device for marking a roadway with marker embedded in the roadway.

2. Description of the Prior Art

The use of roadway marker devices is known in the prior art. More specifically, roadway marker devices heretofore devised and utilized are known to consist basically of familiar, expected and obvious structural configurations notwithstanding the myriad of designs encompassed by the crowded prior art which have been developed for the fulfillment of countless objectives and requirements.

Known prior art includes U.S. Pat. Nos. 5,327,850; 5,108,218; 5,679,437; 2,430,534; 5,097,358; and U.S. Des. No. 397,555.

While these devices fulfill their respective, particular objectives and requirements, the aforementioned patents do not disclose a new roadway marker device. The inventive device includes an elongate member having a first end and a second end. The elongate member has a top wall and a bottom wall. A reflective strip enhances night time visibility of the elongate member. The reflective strip has a first side and a second side. The first side of the strip is adapted to reflect light. The second side of the strip has adhesive thereon. The second side of the strip is adhesively coupled to a surface of the top wall of the elongate member. The elongate members are placed in the roadway such that the top wall of the elongate member is generally flush with the roadway.

In these respects, the roadway marker device according to the present invention substantially departs from the conventional concepts and designs of the prior art, and in so doing provides an apparatus primarily developed for the purpose of marking a roadway with marker embedded in the roadway.

SUMMARY OF THE INVENTION

In view of the foregoing disadvantages inherent in the known types of roadway marker devices now present in the prior art, the present invention provides a new roadway marker device construction wherein the same can be utilized for marking a roadway with marker embedded in the roadway.

The general purpose of the present invention, which will be described subsequently in greater detail, is to provide a new roadway marker device apparatus and method which has many of the advantages of the roadway marker devices mentioned heretofore and many novel features that result in a new roadway marker device which is not anticipated, rendered obvious, suggested, or even implied by any of the prior art roadway marker devices, either alone or in any combination thereof.

To attain this, the present invention generally comprises an elongate member having a first end and a second end. The elongate member has a top wall and a bottom wall. A reflective strip enhances night time visibility of the elongate member. The reflective strip has a first side and a second side. The first side of the strip is adapted to reflect light. The second side of the strip has adhesive thereon. The second side of the strip is adhesively coupled to a surface of the top wall of the elongate member. The elongate members are placed in the roadway such that the top wall of the elongate member is generally flush with the roadway.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roadway marker device apparatus and method which has many of the advantages of the roadway marker devices mentioned heretofore and many novel features that result in a new roadway marker device which is not anticipated, rendered obvious, suggested, or even implied by any of the prior art roadway marker devices, either alone or in any combination thereof.

It is another object of the present invention to provide a new roadway marker device which may be easily and efficiently manufactured and marketed.

It is a further object of the present invention to provide a new roadway marker device which is of a durable and reliable construction.

An even further object of the present invention is to provide a new roadway marker device which is susceptible of a low cost of manufacture with regard to both materials and labor, and which accordingly is then susceptible of low prices of sale to the consuming public, thereby making such roadway marker device economically available to the buying public.

Still yet another object of the present invention is to provide a new roadway marker device which provides in the apparatuses and methods of the prior art some of the advantages thereof, while simultaneously overcoming some of the disadvantages normally associated therewith.

Still another object of the present invention is to provide a new roadway marker device for marking a roadway with marker embedded in the roadway.

Yet another object of the present invention is to provide a new roadway marker device which includes an elongate member having a first end and a second end. The elongate member has a top wall and a bottom wall. A reflective strip enhances night time visibility of the elongate member. The reflective strip has a first side and a second side. The first side of the strip is adapted to reflect light. The second side of the strip has adhesive thereon. The second side of the strip is adhesively coupled to a surface of the top wall of the elongate member. The elongate members are placed in the roadway such that the top wall of the elongate member is generally flush with the roadway.

Still yet another object of the present invention is to provide a new roadway marker device that can be molded for corners or wherever a typical road paint and tape may be used.

Even still another object of the present invention is to provide a new roadway marker device that will not wear away due to weather or the effects of traffic and roadway cleaning and plowing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic plan view of a new roadway marker device according to the present invention.

FIG. 2 is a schematic top view of the present invention.

FIG. 3 is a schematic cross-sectional view of the present invention.

DESCRIPTION OF THE PREFERRED EMBODIMENT

Figure 4:
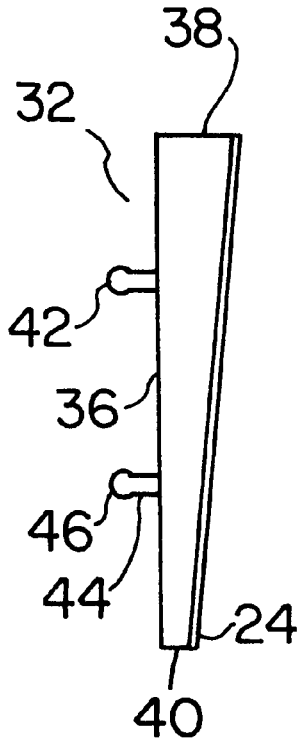
FIG. 4 is a schematic side view of a connecting member of the present invention.
Figure 5:
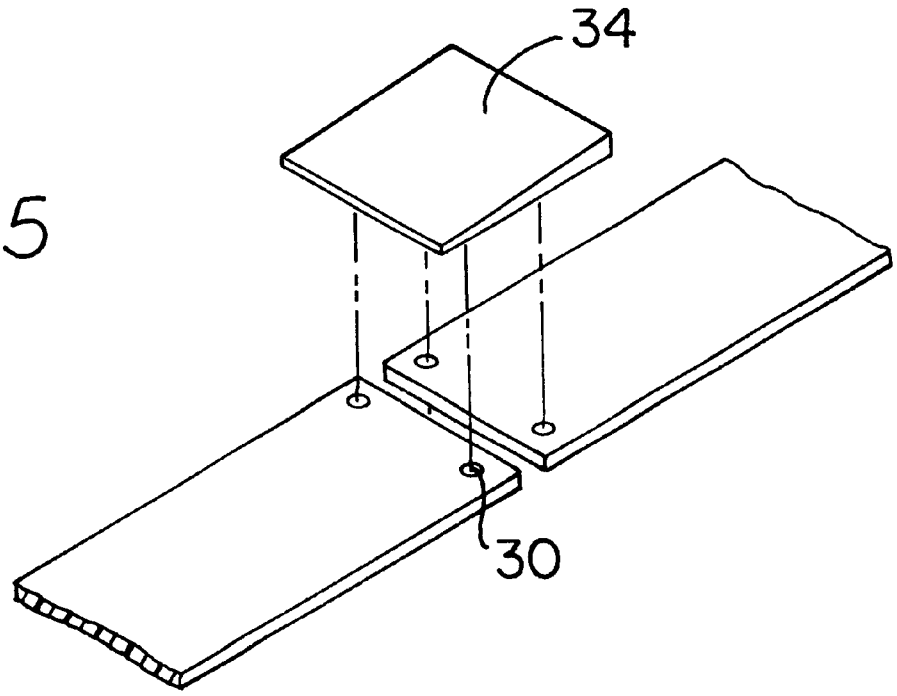
FIG. 5 is a schematic perspective view of the present invention.

With reference now to the drawings, and in particular to FIGS. 1 through 5 thereof, a new roadway marker device embodying the principles and concepts of the present invention and generally designated by the reference numeral 10 will be described.

As best illustrated in FIGS. 1 through 5, the roadway marker device 10 generally comprises an elongate member 12 having a first end 14 and a second end 16. The elongate member has a top wall 18, a bottom wall 20, and has a middle portion 22. The elongate member 12 is preferably colored white. Ideally, the elongate 12 member is formed from a moldable material such as plastic. The elongate member has generally rectangular shape. Ideally, the elongate member has a length generally between four and five feet, a width substantially equal to four inches, and a height substantially equal to one-eighth of an inch.

A reflective strip 24 enhances night time visibility of the elongate member 12. The reflective strip 24 has a first side 26 and a second side 28. The first side 26 of the strip 24 is adapted to reflect light. The second side 28 of the strip 24 has adhesive thereon. The second side 28 of the strip 24 is adhesively coupled to a surface of the top wall 18 of the elongate member 12. The reflective strip 24 is generally located in a middle portion 22 of the elongate member 12. Preferably, the reflective strip 28 has a width generally equal to a width of the elongate member 12, and a length generally between four and five inches.

A plurality of bores 30 is located in the top wall 18 of the elongate members 12. A pair of each of the bores 30 is located generally adjacent to both of the first 14 and second ends 16 of the elongate member.

A plurality of connecting members 32 connect a plurality of elongate members together 12. Each of the connecting members 32 has a top wall 34, a bottom wall 36, and a first 38 and second opposing wall 40. Ideally, the first opposing wall 38 has a height larger than the second opposing wall 40 such that the top wall 34 slopes downward toward the second opposing wall 40 with respect to the bottom wall 36. The shorter side is directed toward traffic to minimize damage to the connecting member from being run over by vehicles. Reflective strips 24 can be placed on the connecting members as well.

A plurality of fasteners 42 is connected to and extends away from the bottom wall 36 of the connecting members 32. Two of the fasteners are located generally adjacent to the first opposing edge 38. Two of the fasteners are generally adjacent to the second opposing, edge 40. Each of the fasteners has a peg portion 44 and a bulbous head portion 46 of a diameter larger than the peg portion. The bulbous head helps to hold the peg portion 44 in the bore 30.

The fasteners 42 are inserted into the bores 30 thereby connecting a first end 14 of one elongate member 12 to a second end 16 of a second elongate member.

In use, the elongate members 12 are ideally inserted into the surface of the roadway when the roadway is made. The top wall 18 of the elongate member 12 being flush with the surface of the road way. Unlike paint and tape, the elongate members 12 will not wear away which enhances their visibility. The addition of a reflective strip 24 only increases the visibility. The elongate members 12 can be used individually or they can be connected together to form a continuous line. The elongate members 12 would be moldable to serve as markers on curves as well as straight roadways.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A roadway marker device for increasing visibility of the edges of lanes of a roadway, said device comprising:

an elongate member, said elongate member having a first end and a second end, said elongate member having a top wall and a bottom wall;

a reflective strip for enhancing night time visibility of said elongate member, said reflective strip having a first side and a second side, said first side of said strip being adapted to reflect light, said second side of said strip having adhesive thereon, said second side of said strip being adhesively coupled to a surface of said top wall of said elongate member;

wherein said elongate member is adapted to be placed in a roadway such that said top wall of said elongate member is generally flush with said roadway;

a plurality of bores, said bores being located in said top wall of said elongate members, a pair of each of said bores being located generally adjacent to both of said first and second ends; and a plurality of connecting members for connecting a plurality of elongate members together, each of said connecting members being adapted to connect a first end of an elongate member to a second end of another elongate member.

2. The roadway marker device for increasing visibility of the edges of lanes of a roadway as in claim 1, wherein said elongate member comprises:

said elongate member being colored white, said elongate member being formed from a moldable material, said elongate member having generally rectangular shape.

3. The roadway marker device for increasing visibility of the edges of lanes of a roadway as in claim 1, wherein said elongate member comprises:

said elongate member having a length generally between four and five feet, said elongate member having a width substantially equal to four inches, said elongate member having a height substantially equal to one-eighth of an inch.

4. The roadway marker device for increasing visibility of the edges of lanes of a roadway as in claim 1, wherein said reflective strip comprises:

said reflective strip being generally located in a middle portion of said elongate member, said reflective strip having a width generally equal to a width of said elongate member, said reflective strip having a length generally between four and five inches.

5. A roadway marker device for increasing visibility of the edges of lanes of a roadway, said device comprising:

an elongate member, said elongate member having a first end and a second end, said elongate member having a top wall and a bottom wall, said elongate member having a middle portion, said elongate member being colored white, said elongate member being formed from a moldable material, said moldable material being plastic, said elongate member having generally rectangular shape, said elongate member having a length generally between four and five feet, said elongate member having a width substantially equal to four inches, said elongate member having a height substantially equal to one-eighth of an inch;

a reflective strip for enhancing night time visibility of said elongate member, said reflective strip having a first side and a second side, said first side of said strip being adapted to reflect light, said second side of said strip having adhesive thereon, said second side of said strip being adhesively coupled to a surface of said top wall of said elongate member, said reflective strip being generally located in a middle portion of said elongate member, said reflective strip having a width generally equal to a width of said elongate member, said reflective strip having a length generally between four and five inches;

a plurality of bores, said bores being located in said top wall of said elongate members, a pair of each of said bores being located generally adjacent to both of said first and second ends;

a plurality of connecting members for connecting a plurality of elongate members together, each of said connecting members having a top wall, a bottom wall, and a first and second opposing wall, said first opposing wall having a height larger than said second opposing wall such that said top wall slopes downward toward said second opposing wall with respect to said bottom wall;

a plurality of fasteners, each of said fasteners being connected to and extending away from said bottom wall of said connecting members, two of said fasteners being located generally adjacent to said first opposing edge, two of said fasteners being generally adjacent to said second opposing edge, each of said fasteners having a peg portion and a bulbous head portion of a diameter larger than said peg portion; and wherein said fasteners are inserted into said bores thereby connecting a first end of one elongate member to a second end of a second elongate member.

6. A roadway marker device for increasing visibility of the edges of lanes of a roadway, said device comprising:

an elongate member having a first end and a second end, said elongate member having a top wall and a bottom wall;

a reflective strip for enhancing night time visibility of said elongate member, said reflective strip having a first side and a second side, said first side of said strip being adapted to reflect light, said second side of said strip being adhered to a surface of said top wall of said elongate member;

wherein said elongate member is positionable on a roadway such that said top wall of said elongate member is generally flush with said roadway;

a plurality of connecting members, each of said connecting members having a top wall, a bottom wall, and a first and second opposing wall, said first opposing wall having a height larger than said second opposing wall such that said top wall slopes downward toward said second opposing wall with respect to said bottom wall;

a plurality of fasteners, each of said fasteners being connected to and extending away from said bottom wall of said connecting members, two of said fasteners being located generally adjacent to said first opposing edge, two of said fasteners being generally adjacent to said second opposing edge, each of said fasteners having a peg portion and a bulbous head portion of a diameter larger than said peg portion; and wherein said fasteners are inserted into said bores thereby connecting a first end of one elongate member to a second end of a second elongate member.

7. The roadway marker device for increasing visibility of the edges of lanes of a roadway as in claim 6, wherein said elongate member is colored white, said elongate member being formed from a moldable material, said elongate member having generally rectangular shape.

8. The roadway marker device for increasing visibility of the edges of lanes of a roadway as in claim 6, wherein said elongate member has a length generally between four and five feet, said elongate member having a width substantially equal to four inches, said elongate member having a height substantially equal to one-eighth of an inch.

9. The roadway marker device for increasing visibility of the edges of lanes of a roadway as in claim 6, wherein said reflective strip is generally located in a middle portion of said elongate member, said reflective strip having a width generally equal to a width of said elongate member, said reflective strip having a length generally between four and five inches.

* * * * *